United States Patent [19]

Sanville

[11] 4,441,196

[45] Apr. 3, 1984

[54] SPEED INDEPENDENT SYSTEM FOR OBTAINING PRESELECTED NUMBERS OF SAMPLES FROM OBJECT MOVING ALONG FIXED PATH

[75] Inventor: W. Woodward Sanville, Brentwood, N.Y.

[73] Assignee: Servo Corporation of America, Hicksville, N.Y.

[21] Appl. No.: 125,487

[22] Filed: Feb. 28, 1980

[51] Int. Cl.[3] ..... G06M 3/02

[52] U.S. Cl. ..... 377/9; 377/20; 377/44; 364/179; 364/565; 364/426; 340/47; 246/169 A; 246/182 R; 246/169 D

[58] Field of Search ..... 235/92 T, 92 FQ, 92 TC, 235/92 DN, 92 DM, 92 CP, 92 AE; 340/146.3 K, 23, 47, 670; 364/111, 561, 569, 174, 178, 179, 565, 438, 426; 324/160, 161, 166, 178; 368/6, 8, 89, 2, 108, 111; 246/169 D, 169 R, 169 S, 169 A, 247, 255, 316, 182 A, 182 R, 182 B; 73/1 D, 488, 510, 518; 250/359.1, 221.1, 222.1, 223; 377/44, 9, 20; 328/5

[56] References Cited

U.S. PATENT DOCUMENTS

| | | | |
|---|---|---|---|
| 3,436,656 | 4/1969 | Brand | 324/178 |
| 3,440,421 | 4/1969 | Lowman et al. | 250/359.1 |
| 3,558,876 | 1/1971 | Tillman et al. | 246/169 S |
| 3,639,753 | 2/1972 | Reich | 324/161 |
| 3,646,343 | 2/1972 | Caulier et al. | 246/169 D |
| 3,649,818 | 3/1972 | Sylvander et al. | 364/565 |
| 3,655,962 | 4/1972 | Koch | 324/166 |
| 3,766,368 | 10/1973 | Weber et al. | 235/151.11 |
| 3,919,526 | 11/1975 | Pommers et al. | 235/61.6 A |
| 3,931,498 | 1/1976 | Bowker | 235/92 DN |
| 3,987,278 | 10/1976 | Van Elzakker et al. | 235/436 |
| 4,071,282 | 1/1978 | Callahan et al. | 303/106 |
| 4,079,323 | 3/1978 | Blanyer | 328/5 |
| 4,100,599 | 7/1978 | Nally | 364/565 |
| 4,113,211 | 9/1978 | Glazar | 246/169 A |
| 4,129,276 | 12/1978 | Svet | 246/169 S |
| 4,163,283 | 7/1979 | Darby | 364/439 |
| 4,180,726 | 12/1979 | DeCrescent | 250/222 R |
| 4,256,278 | 3/1981 | Sanville | 246/247 |
| 4,265,419 | 5/1981 | Scorteanu | 246/247 |
| 4,283,031 | 8/1981 | Finch | 246/128 |
| 4,313,583 | 2/1982 | Bambara et al. | 246/169 A |
| 4,323,211 | 4/1982 | Bambara et al. | 246/169 A |
| 4,385,227 | 5/1983 | Bridges | 377/2 |

FOREIGN PATENT DOCUMENTS

| | | | |
|---|---|---|---|
| 969348 | 9/1964 | United Kingdom | 246/169 R |

*Primary Examiner*—James D. Thomas
*Assistant Examiner*—Archie E. Williams, Jr.
*Attorney, Agent, or Firm*—Kane, Dalsimer, Kane and Kurucz

[57] ABSTRACT

A speed independent system is used for obtaining a preselected number of samples from an object moving along a fixed path, such as a railroad train passing through a sensing zone along the section of track. The sensing zone is defined by a pair of wheel sensors. Upstream of the sensing zone a third sensor is positioned. The distance between the third sensor and the closer of the pair of sensors comprises a reference distance which is the length of the sensing zone multiplied by a known multiple. The time for the train to pass through the reference distance is obtained and then divided by a divisor comprising the product of the known multiple and the desired number of samples to obtain a single interval. During the time the train passes through the sensing zone consecutive intervals are counted off to obtain the desired number of samples.

11 Claims, 2 Drawing Figures

FIG. 1
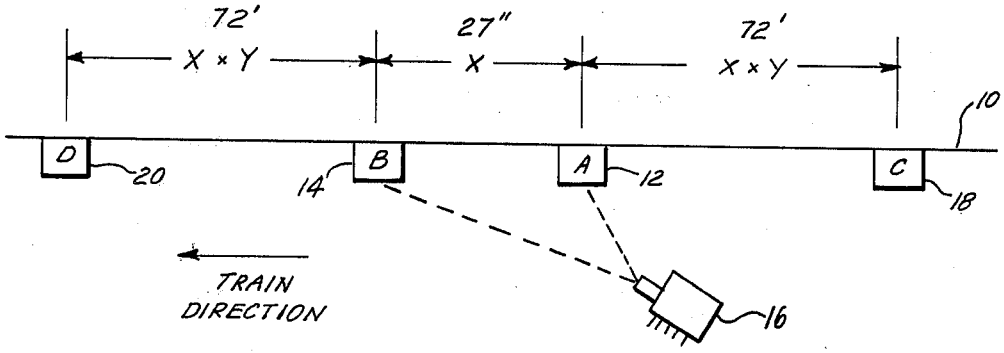
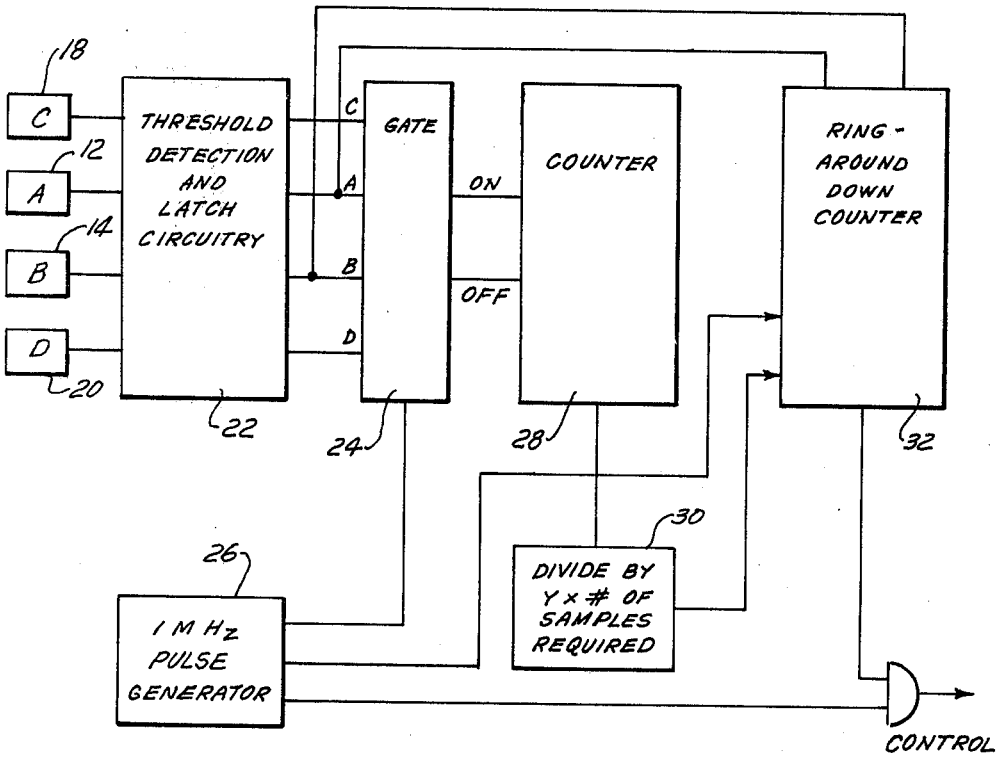
FIG. 2

SPEED INDEPENDENT SYSTEM FOR OBTAINING PRESELECTED NUMBERS OF SAMPLES FROM OBJECT MOVING ALONG FIXED PATH

BACKGROUND OF THE INVENTION

The present invention relates to moving equipment, such as railroads and the like, and in particular to a system for obtaining a preselected number of data samples from the moving equipment while passing through a selected portion of its path of travel independent of the speed of travel.

Railroads are commonly provided with various types of scanning devices along their track sites which extract information from passing railroad cars. One such scanning device may, for example, be a hot bearing detector such as that disclosed in U.S. Pat. No. 3,545,005 and marketed by the Servo Corporation of America of Hicksville, New York under the trade name HOT BOX DETECTIVE. As each wheel of the train enters a scanning zone, an infrared scanner generates a waveform indicative of the temperature of the bearing for that wheel. Information can be obtained from the waveform as to whether the bearing is operating properly or not. Such scanning systems have heretofore been real time analog systems. However, with the increasing use of microprocessors, it is desirable to obtain such information in a discrete form for subsequent processing. To this end, it is necessary to obtain discrete information from the scanner as the wheel passes through the scanning zone. The problem in obtaining such discrete information is that the equipment has no way of knowning at what speed the train will pass through the scanning zone and hence the rate at which data is extracted from the scanner must be totally independent of train speed.

In view of the above, it is a principal object of the present invention to provide a system for obtaining a preselected number of samples from a scanner viewing an object moving through a scanning zone independent of the speed at which the object moves through the zone.

A further object is to provide such a system which utilizes available components and would be readily compatible with existing equipment.

A still further object is to provide such a system which, in addition to being independent of the speed of the moving object is also independent of the direction of the moving object.

Still further objects and advantages will become apparent from the following description of the present invention.

SUMMARY OF THE INVENTION

The above and other objects and advantages are attained in accordance with the present invention by providing along the path of motion of a railroad car or the like first and second sensors to determine when the car enters and leaves a sensing zone. Upstream of the sensing zone a third sensor is positioned. The distance between the third sensor and the closer of the first and second sensors comprises a reference distance which is the length of the sensing zone multiplied by a known multiple. Preferably the multiple is also the same number as the number of samples required while the car is within the sensing zone.

The time the car takes to traverse the reference distance is used to start and stop a first counter which counts pulses generated by a clock. When the first counter stops (i.e., when the car traverses the reference distance and reaches the sensing zone) a second, ring-around counter is set by the first counter to the count reached by the first counter divided by the product of the known factor and the number of samples required. Each time the second counter reaches zero a pulse is triggered and the second counter returns to its initial setting and resumes counting down. As a result, as the car passes through the sensing zone, the time it takes to pass through the sensing zone will be divided into the required number of samples, regardless of the speed of the car.

The foregoing is independent of speed but assumes that the speed of the car remains constant from the time the car starts to traverse the predetermined distance until the car leaves the sensing zone.

For bi-directional capabilities, a fourth sensor may be positioned downstream of the sensing zone. The tripping of either the third or fourth sensor triggers the first counter. A determination of whether the third or fourth sensor was in fact triggered determines the direction of the car.

BRIEF DESCRIPTION OF THE DRAWINGS

In the accompanying drawings:

FIG. 1 is a schematic diagram of a section of railroad track showing wheel sensors in location as required in accordance with the present invention; and FIG. 2 is a block diagram of the circuitry utilized in accordance with the present invention.

BRIEF DESCRIPTION OF THE PREFERRED EMBODIMENT

Reference is now made to the drawings and to FIG. 1 in particular wherein the present invention is shown as being utilized along a section of railroad track. In accordance with the present invention, a section of track 10 is shown having a pair of wheel sensors 12 and 14 positioned along the track to define a sensing zone the length of which is equal to a distance "x." An infrared hot bearing detector 16 such as that disclosed in the previously mentioned U.S. Pat. No. 3,545,005 is positioned along the track to scan each bearing of a railroad car as the car passes through the sensing zone. The wheel sensors which are of conventional design and are commercially available, serve to generate a signal each time a railroad car wheel passes over it.

In accordance with the present invention a third wheel sensor 18 is positioned upstream of the sensing zone. The distance from wheel sensor 18 to wheel sensor 12, the closer of wheel sensors 12 and 14, comprises a reference distance which is a known multiple "y" of the distance "x" between sensors 12 and 14 (i.e., the length of the reference distance is x·y). A fourth wheel sensor 20 is positioned the same distance from wheel sensor 14 that wheel sensor 18 is from wheel sensor 12. Thus, if a train moves in the direction indicated by the arrow wheel sensor 18 will trigger a first signal, followed by signals triggered by wheel sensors 12, 14 and 20 in that order. During the time period starting with the triggering of counter 32 by wheel sensor 12 and ending with the triggering of wheel sensor 14 by a particular wheel, the bearing of that wheel will be scanned by scanner 16.

As stated, the principal object of the present invention is to enable the scanner 16 to sample each wheel bearing a fixed number of times as it passes from sensor 12 to sensor 14 regardless of the speed at which the train is moving. To this end, the circuitry depicted in FIG. 2 is utilized.

As shown in FIG. 2, as a train wheel passes each of the sensors 18, 12, 14 and 20 along the track a signal is generated. The signals from the sensors are fed to a threshold detection and latch circuit 22 which first serves to insure that each sensor signal exceeds a fixed threshold value, selected to eliminate extraneous noise and misreadings caused by animals crossing the track, vandalism, and the like. Circuit 22 also performs the necessary time latching functions as required. The output of circuit 22 is fed to a gate 24 along with the output pulses of a 1 MHz pulse generator. Circuit 22 maintains gate 24 in an "on" state from the time the wheel passes sensor 18 until it reaches sensor 12 and thereafter turns the gate "off". The output of gate 24 is fed to a counter 28 and accordingly counter 28 counts the number of clock pulses from the time the wheel passes sensor 18 until it passes sensor 12. The output of counter 28 is fed to a divider 30 the divisor of which comprises N·y the product of (a) the number of samples required ("N") and (b) the multiple of the sensing zone by which the reference distance exceeds the sensing zone ("y"). The output of divider 30 which comprises a single interval of time is used to set a ring-around down counter 32. Counter 32 serves to count down to zero from the number set by divider 30 with each advance pulse from clock pulse generator 26. Thus, each time counter 32 reaches zero another time interval has elapsed. Counter 32 is turned on when sensor 12 is triggered and counter 32 is turned off when sensor 14 is triggered and thus counts down clock pulses when the wheel under observation is within the sensing zone. Each time counter 32 reaches zero it automatically re-sets to the number determined by the divided output of counter 28.

The output of counter 32 is gated through gate 34 with the clock pulse generator 26 so that each time counter 32 reaches zero a sample control pulse is generated. During the time it takes for the wheel to pass from sensor 12 to sensor 14, N control pulses will be generated equi-spaced in time. This follows from the following mathematics:

$$\text{Output of counter 32} = \frac{\text{output of counter 28}}{D} = \frac{T_{\overline{AC}}}{D}$$

where $T_{\overline{AC}}$ = time to travel distance $\overline{AC}$ $D$ = divisor of divider 30 = $y \cdot N$ $N$ = number of samples required $y$ = multiplier of distance $\overline{AB}$ to obtain distance $\overline{AC}$ but $$\frac{T_{\overline{AC}}}{D} = \frac{\overline{AC}}{v \cdot D}$$

where $v$ = velocity of wheel, and

-continued $$\overline{AC} = \overline{AB} \cdot y$$

therefore $$\frac{T_{\overline{AC}}}{D} = \frac{\overline{AC}}{v \cdot D} = \frac{\overline{AB} \cdot y}{v \cdot y \cdot N} = \frac{\overline{AB}}{v \cdot N}$$

but $$\frac{\overline{AB}}{v} = T_{\overline{AB}} = \text{time to travel distance } \overline{AB}$$

therefore the output of counter 32, $\frac{T_{\overline{AC}}}{D} = \frac{T_{\overline{AB}}}{D}$ regardless of the value of v.

From the above, it can be seen that as long as the velocity of the wheel remains constant during the period from which it passes through the reference distance until it passes through the sensing zone the output of counter 32 will equal the time required to travel the distance between sensors 12 and 14 divided by the desired number of samples independent of the velocity of the train.

The above description was prepared for a train travelling in the direction indicated in FIG. 1. If the train were travelling in the opposite direction, sensor 18 would be replaced by sensor 20 and sensors 12 and 14 would be reversed for all purposes.

In a successful practice of this invention, sensors 12 and 14 were placed 27 inches apart while sensor 18 was spaced 72 feet from sensor 12 and sensor 20 was spaced 72 feet from sensor 14. As a result, the multiple y, was equal to 32. The desired number of samples was also 32 so that divider 30 was set to divide by 32·32 or 1024.

Thus, in accordance with the above, the aforementioned objects are effectively attained.

Having thus described the invention, what is claimed is:

1. A method for obtaining a predetermined number of data samples of equal time intervals from an object passing through a sensing zone independent of the speed at which the object passes through the sensing zone by dividing the time in which the object passes through the sensing zone into said predetermined number of equal time intervals regardless of the speed of the object and samping the object during each of the intervals, said method comprising the steps of:

(a) establishing a first reference distance upstream of said sensing zone which is a known multiple of the length of said sensing zone;

(b) measuring the time required for the object to pass through said reference distance;

(c) dividing the aforementioned time by a divisor comprising the product of said known multiple and the predetermined number whereby to obtain a single time interval;

(d) consecutively counting off single time intervals during the time said object passes through the sensing zone; and, (e) obtaining a data sample from said object during each of said single intervals whereby to obtain said predetermined number of data samples regardless of the speed of the object.

2. The method in accordance with claim 1 including the further step of establishing another reference distance downstream of said sensing zone.

3. The method in accordance with claim 1 wherein said reference distance is established immediately upstream and adjacent to said sensing zone.

4. The method in accordance with claim 3 including the further steps of establishing another reference distance equal to said first reference distance downstream of said sensing zone.

5. A system for obtaining a predetermined number of data samples from an object passing through a sensing zone by dividing the time in which the object passes through the sensing zone into a predetermined number of equi-timed intervals and sampling the object during each of the intervals comprising:

first and second sensors in the path of motion of said object defining the beginning and end of said sensing zone;

data sampling means adapted to obtain data from said object when said object is in said sensing zone;

sensing means positioned upstream of said sensing zone for defining a reference zone distance in the path of motion of said object, the length of said reference zone distance being a known multiple of the length of said sensing zone distance;

first timer means connected to said sensing means to determine the time required for said object to traverse said reference distance and to generate a number value output indicative of said time;

divider means connected to said first timer and adapted to divide said number value by the product of said predetermined number and known multiple to obtain a time interval value; and, second timer means connected to said first and second sensors and to the output of said divider to generate a signal to said data sampling means for each elapsed time interval as the object moves through said sensing zone whereby said data sampling means may obtain said predetermined number of data samples from said object as said object moves through said sensing zone.

6. The system in accordance with claim 5 further comprising a third sensor and wherein said sensing means comprises said third sensor and one of said first and second sensors.

7. The system in accordance with claim 5 further comprising a clock pulse generator and said first timer means comprises a counter for counting pulses from said generator.

8. The system in accordance with claim 6 wherein said second timer means comprises a second counter for counting pulses from said generator.

9. The system in accordance with claim 5 further comprising additional sensing means downstream of said sensing zone for defining a second reference zone distance in the path of motion of said object, said second reference being said known multiple of the length of said sensing zone distance.

10. The system in accordance with claim 5 wherein said object comprises a railroad car wheel and said first and second sensors comprise wheel sensors.

11. The method in accordance with claim 2 wherein said other reference distance is equal to the first reference distance.

* * * * *